US006863384B2

(12) United States Patent
Jeanmaire

(10) Patent No.: US 6,863,384 B2
(45) Date of Patent: Mar. 8, 2005

(54) CONTINUOUS INK JET METHOD AND APPARATUS

(75) Inventor: David L. Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 152 days.

(21) Appl. No.: 10/061,756

(22) Filed: Feb. 1, 2002

(65) Prior Publication Data

US 2003/0146957 A1 Aug. 7, 2003

(51) Int. Cl.[7] ..... B41J 2/02; B41J 2/175
(52) U.S. Cl. ..... 347/73; 347/93
(58) Field of Search ..... 347/73–74, 77, 347/82, 84–85, 90

(56) References Cited

U.S. PATENT DOCUMENTS

| | | | | |
|---|---|---|---|---|
| 3,596,275 A | | 7/1971 | Sweet | 347/74 |
| 3,972,051 A | | 7/1976 | Lundquist et al. | 347/74 |
| 4,068,241 A | | 1/1978 | Yamada | 347/75 |
| 4,097,872 A | | 6/1978 | Giordano et al. | 347/21 |
| 4,106,032 A | | 8/1978 | Miura et al. | 347/21 |
| 4,297,712 A | | 10/1981 | Lammers et al. | 347/21 |
| 4,341,310 A | | 7/1982 | Sangiovanni et al. | 209/638 |
| 4,350,986 A | | 9/1982 | Yamada | 347/75 |
| 4,728,969 A | | 3/1988 | Le et al. | 347/21 |
| 6,079,821 A | | 6/2000 | Chwalek et al. | 347/82 |
| 6,203,145 B1 | | 3/2001 | Jeanmaire et al. | 347/75 |
| 6,457,807 B1 | * | 10/2002 | Hawkins et al. | 347/40 |
| 6,474,781 B1 | * | 11/2002 | Jeanmaire | 347/47 |
| 6,505,921 B2 | * | 1/2003 | Chwalek et al. | 347/77 |

* cited by examiner

*Primary Examiner*—K. Feggins
(74) *Attorney, Agent, or Firm*—William R. Zimmerli

(57) ABSTRACT

A continuous inkjet method and apparatus including a printhead (2) having an orifice (7) for ejecting a continuous stream of ink droplets of a larger size (21) and a smaller size (23), and a droplet filter (41) for generating a liquid curtain (43) that captures and absorbs the smaller droplets (23) but admits the larger droplets (21). The liquid curtain (43) is orthogonally disposed with respect to the stream of ink droplets (21, 23) and the liquid curtain (43) is the same type of ink as the droplets. The droplet filter (41) in one embodiment includes a source of pressurized ink (51), a nozzle (45) connected to the pressurized ink source (51), and an ink recycler (57) for recapturing and recycling ink. The droplet filter nozzle (45) of one embodiment has a slit-type opening and is directed downwardly in the same direction as the force of gravity.

19 Claims, 3 Drawing Sheets

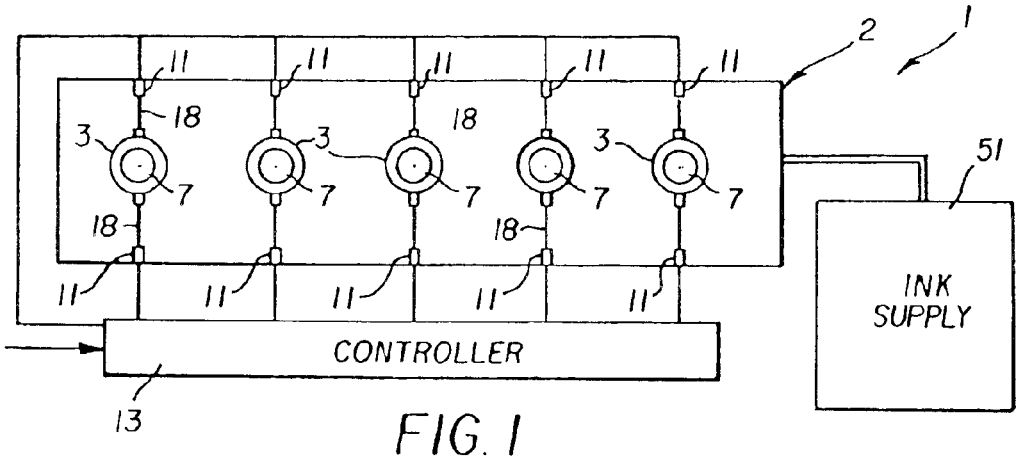
FIG. 1
FIG. 2A
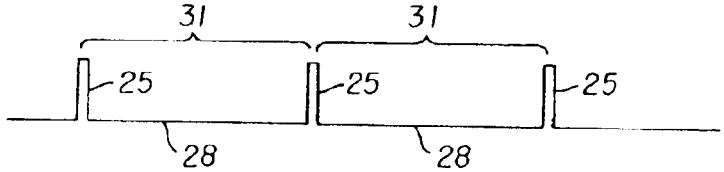
FIG. 2B
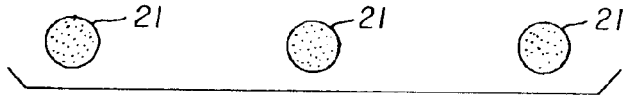
FIG. 2C
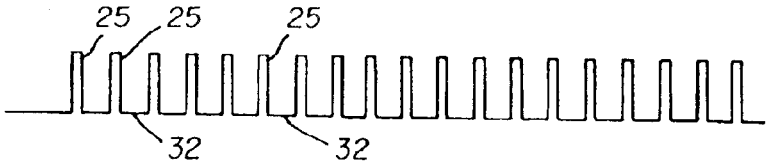
FIG. 2D
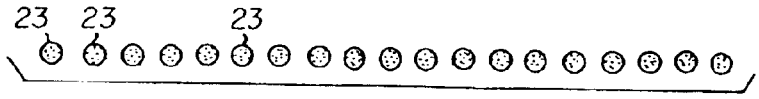
FIG. 2E
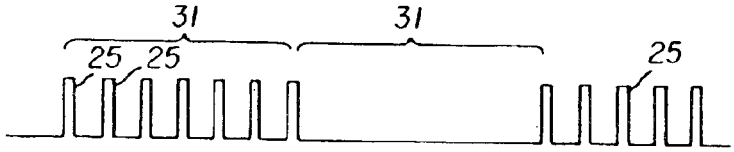
FIG. 2F
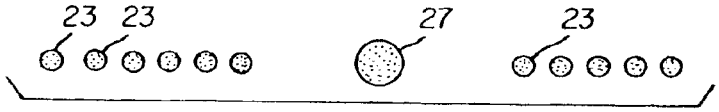

CONTINUOUS INK JET METHOD AND APPARATUS

FIELD OF THE INVENTION

The present invention generally relates to the field of inkjet printing devices. In particular, the present invention relates to continuous ink jets wherein a curtain of liquid is used to control ink droplets during the printing operation.

BACKGROUND OF THE INVENTION

Ink jet printing has become recognized as a prominent contender in the digitally controlled, electronic printing arena because of various advantages such as its non-impact, low noise characteristics and system simplicity. For these reasons, ink jet printers have achieved commercial success for home and office use and other areas.

Traditionally, color ink jet printing is accomplished by one of two technologies, referred to as drop-on-demand and continuous stream printing. Both technologies require independent ink supplies for each of the colors of ink provided. Ink is fed through channels formed in the printhead. Each channel includes a nozzle from which droplets of ink are selectively extruded and deposited upon a medium. Ordinarily, the three primary subtractive colors, i.e. cyan, yellow and magenta, are used because these colors can produce up to several million perceived color combinations.

In drop-on-demand ink jet printing, ink droplets are generated for impact upon a print medium using a pressurization actuator (thermal, piezoelectric, etc.). Selective activation of the actuator causes the formation and ejection of an ink droplet that crosses the space between the printhead and the print medium and strikes the print medium. The formation of printed images is achieved by controlling the individual formation of ink droplets as the medium is moved relative to the printhead. A slight negative pressure within each channel keeps the ink from inadvertently escaping through the nozzle, and also forms a slightly concave meniscus at the nozzle, thus helping to keep the nozzle clean.

In continuous stream or continuous inkjet printing, a pressurized ink source is used for producing a continuous stream of ink droplets. Conventional continuous ink jet printers utilize electrostatic charging devices that are placed close to the point where a filament of working fluid breaks into individual ink droplets. The ink droplets are electrically charged and then directed to an appropriate location by deflection electrodes having a large potential difference. When no printing is desired, the ink droplets are deflected into an ink capturing mechanism (catcher, interceptor, gutter, etc.) and either recycled or discarded. When printing is desired, the ink droplets are not deflected and allowed to strike a print media. Alternatively, deflected ink droplets may be allowed to strike the print media, while non-deflected ink droplets are collected in the ink capturing mechanism. While such continuous inkjet printing devices are faster than drop on demand devices and produce higher quality printed images and graphics, the electrostatic deflection mechanism they employ is expensive to manufacture and relatively fragile during operation.

Recently, a novel continuous ink jet printer system has been developed which renders the above-described electrostatic charging devices unnecessary and provides improved control of droplet formation. The system is disclosed in the commonly assigned U.S. Pat. No. 6,079,821 in which periodic application of weak heat pulses to the ink stream by a heater causes the ink stream to break up into a plurality of droplets synchronous with the applied heat pulses and at a position spaced from the nozzle. The droplets are deflected by increased heat pulses from a heater in a nozzle bore. This is referred to as asymmetrical application of heat pulses. The heat pulses deflect ink drops between a "print" direction (onto a recording medium), and a "non-print" direction (back into a "catcher"). Although solvent-based inks such as alcohol-based inks have quite good deflection patterns and achieve high image quality in asymmetrically heated continuous ink jet printers, water-based inks do not deflect as much, and consequently, their operation is not as robust.

Still other methods of continuous ink jet printing employ air flow in the vicinity of ink streams for various purposes. For example, U.S. Pat. No. 3,596,275 discloses the use of both collinear and perpendicular air flow to the droplet flow path to remove the effect of the wake turbulence on the path of succeeding droplets. This work was expanded upon in U.S. Pat. No. 3,972,051, U.S. Pat. No. 4,097,872, and U.S. Pat. No. 4,297,712 in regards to the design of aspirators for use in droplet wake minimization. U.S. Pat. No. 4,106,032 and U.S. Pat. No. 4,728,969 employ a coaxial air flow to assist jetting from a drop-on-demand type head.

One problem associated with inkjet printers in general and such printers employing gas or air flows in particular is the drying of the ink. Ink drying in the vicinity of the printhead nozzles can lead to spurious droplet trajectories and nozzle clogging which in turn complicate the proper deflection of the print droplets. Additionally, the evaporation of the ink solvent from the droplets as they fly through the air can increase the viscosity of the ink captured by the gutter, thereby causing difficulties during the ink recycling operation when the recycled ink is passed through a filter.

Clearly, there is a need for a continuous ink jet method and printing apparatus with a simpler, less expensive and more robust ink deflection or control mechanism that does not employ air flows in the vicinity of the nozzles. In particular, it would be desirable to provide such a continuous ink jet method and printing apparatus that does not rely upon the electrostatic devices or heater devices for deflection purposes, and that does not employ air flow to avoid the expenses, limitations and disadvantages associated with each of these different technologies.

SUMMARY OF THE INVENTION

The invention is an ink jet printing apparatus that avoids the aforementioned problems associated with the prior art. To this end, the inkjet printing apparatus of the invention comprises an ink droplet forming mechanism for ejecting a stream of ink droplets having a selected one of at least two different volumes, and a droplet filter for producing a liquid curtain that allows ink droplets having a predetermined volume to pass through the droplet filter to the print medium, but captures ink droplets having a volume smaller than the predetermined volume to thereby prevent them from passing through the liquid curtain to the print medium.

In accordance with one embodiment of the present invention, a continuous stream inkjet printer is provided including a printhead having an orifice for continuously ejecting a stream of ink droplets of a larger size and a smaller size, and a droplet filter for generating a liquid curtain between the orifice and a print medium that captures and absorbs the smaller droplets but admits the larger droplets to the print medium through the liquid curtain.

In one embodiment of the present invention, liquid curtain is substantially orthogonally disposed with respect to the stream of ink droplets. In another embodiment, the droplet filter generates the liquid curtain from a same type of ink that forms the ink droplets. In this regard, the droplet filter includes a source of pressurized ink, and a nozzle connected to the pressurized ink source for generating the liquid curtain between the printhead orifice and the print medium. The droplet filter of the continuous stream inkjet printer may also include an ink recycler for recapturing and recycling ink used to form the liquid curtain.

In accordance with still another embodiment of the continuous stream inkjet printer, the droplet filter nozzle has a slit-type opening for ejecting liquid ink in a curtain configuration. In one embodiment, the nozzle directed downwardly such that the liquid curtain is generated in a same direction as the force of gravity.

In accordance with still another aspect of the present invention, a method of controlling application of ink droplets of a continuous stream inkjet printer onto a print medium is provided including the steps of continuously ejecting a stream of ink droplets of selected larger and smaller sizes from an orifice, generating a liquid curtain between the orifice and a print medium, and capturing and absorbing the smaller droplets while admitting the larger droplets through the liquid curtain to the print medium.

In one embodiment, the liquid curtain is preferably substantially orthogonally disposed with respect to the stream of ink droplets. In another embodiment, the method includes the step of generating the liquid curtain from a same type of ink that forms the ink droplets. In this regard, the liquid curtain is generated between the orifice and a print medium by a source of pressurized ink and a nozzle connected to the pressurized ink source. In another embodiment, the method further includes the step of recapturing and recycling the liquid curtain.

In accordance with another embodiment of the present method, the nozzle has a slit-type opening for ejecting liquid ink in a curtain configuration. In yet another embodiment, the method includes the step of directing the nozzle downwardly such that the liquid curtain is generated in a same direction as the force of gravity.

BRIEF DESCRIPTION OF THE DRAWINGS

FIG. 1 is a schematic plan view of a printhead made in accordance with a preferred embodiment of the present invention;

FIGS. 2A–2F illustrate the relationship between the switching frequency of the heaters of the printhead and the volume of ink droplets produced by the orifices adjacent to the heaters;

DETAILED DESCRIPTION OF THE INVENTION

The present description will be directed in particular to elements forming part of, or cooperating more directly with, apparatus and method in accordance with the present invention. It is to be understood that elements not specifically shown or described may take various forms well known to those skilled in the art.

Figure 4:
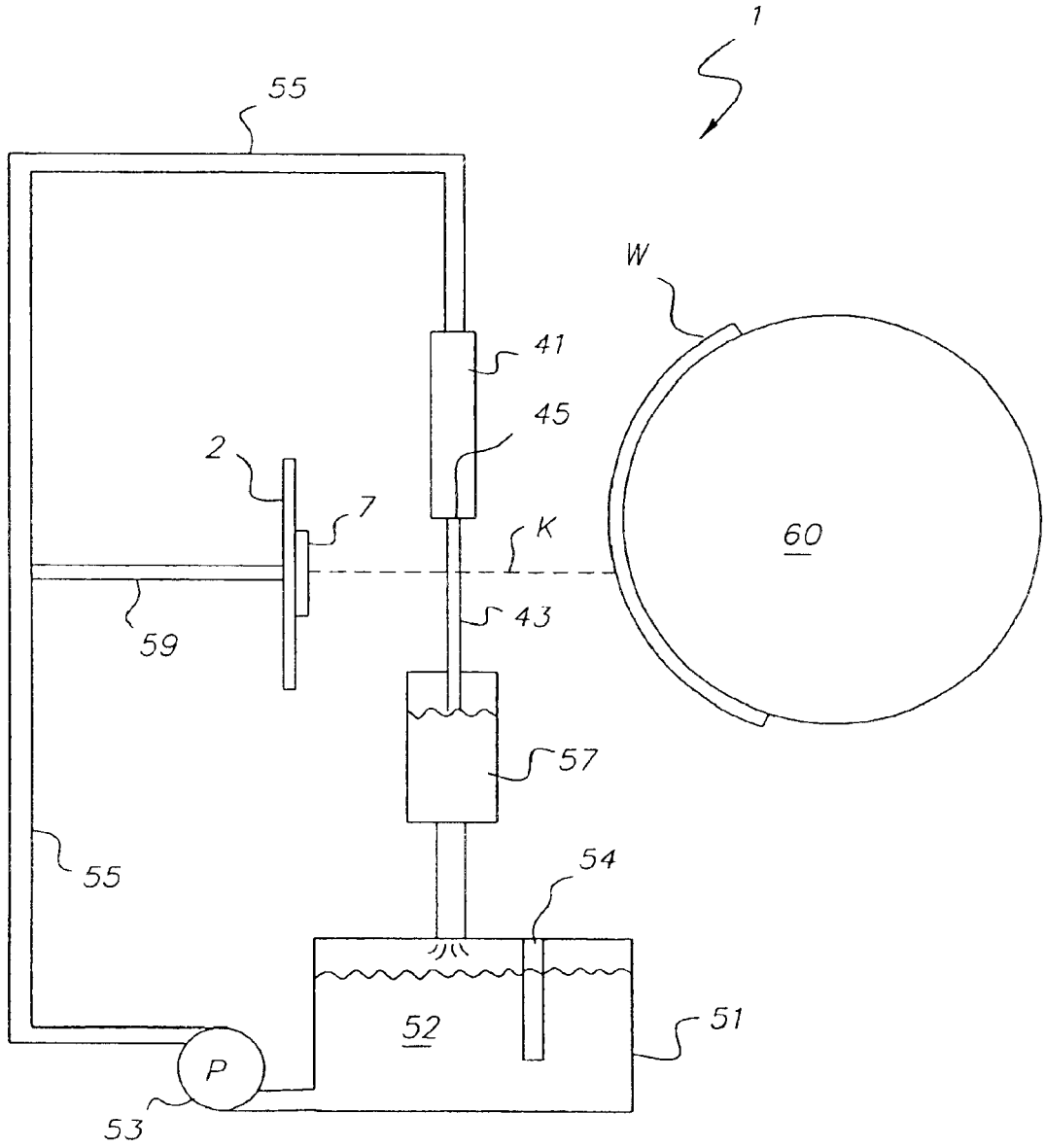
FIG. 4 is a schematic side view of an ink jet printer in accordance with one embodiment of the present invention.

With reference to FIGS. 1 and 4, wherein like reference numerals designate like components throughout all of the several figures, the continuous stream printer 1 of the invention generally comprises an ink droplet forming mechanism in the form of a printhead 2. In a preferred embodiment of the present invention, printhead 2 is formed from a semiconductor material (silicon, etc.) using known semiconductor fabrication techniques such as CMOS circuit fabrication techniques, micro-electro mechanical structure (MEMS) fabrication techniques, etc. However, it is specifically contemplated and therefore, within the scope of this disclosure that printhead 2 may be formed from any materials using any fabrication techniques conventionally known in the art.

Referring in particular to FIG. 1, a plurality of annular heaters 3 are at least partially formed or positioned on the silicon substrate 6 of the printhead 2 around corresponding nozzles or orifices 7. Although each heater 3 may be disposed radially away from an edge of a corresponding orifices 7, the heaters 3 are preferably disposed close to corresponding orifices 7 in a concentric manner. In a preferred embodiment, heaters 3 are formed in a substantially circular or ring shape. However, it is specifically contemplated that heaters 3 may be formed in a partial ring, square, or other shape adjacent to the orifices 7. Each heater 3 in a preferred embodiment is principally comprised of a resistive heating element electrically connected to contact pads 11 via conductors 18. Each orifice 7 is in fluid communication with ink source 51 through an ink passage (not shown) also formed in printhead 2. It is specifically contemplated that printhead 2 may incorporate additional ink supplies in the same manner as ink source 51 as well as additional corresponding orifices 7 in order to provide color printing using three or more ink colors. Additionally, black and white or single color printing may be accomplished using an ink source 51 and orifice 7.

Conductors 18 and electrical contact pads 11 may be at least partially formed or positioned on the printhead 2 and provide an electrical connection between a controller 13 and the heaters 3. Alternatively, the electrical connection between the controller 13 and heater 3 may be accomplished in any other well known manner. Controller 13 may be a relatively simple device (a switchable power supply for heater 3, etc.) or a relatively complex device (a logic controller or programmable microprocessor in combination with a power supply) operable to control many other components of the printer in a desired manner.

In FIGS. 2A–2F, examples of the electrical activation waveforms provided by controller 13 to the heaters 3 during plurality of pixel times 31 are shown, pixel time 31 referring to the duration of time for generating a pixel. Generally, a high frequency of activation of heater 3 where the heater is activated numerous times in a given pixel time 31, each activation being separated by delay time 32, results in small volume droplets 23 as shown in FIGS. 2C and 2D, while a low frequency of activation results in large volume droplets 21 as illustrated in FIGS. 2A and 2B. In accordance with the present invention, large ink droplets are to be used for marking the print medium, while smaller droplets are captured for ink recycling in the manner described herein below. Also in this example, only one printing droplet is provided for per image pixel, thus there are two states of heater actuation, printing or non-printing.

The electrical waveform of heater 3 actuation for large ink droplets 21 is presented schematically as FIG. 2A. The individual large ink droplets 21 produced from the jetting of ink from orifice 7 as a result of low frequency heater actuation are shown schematically in FIG. 2B. Heater actuation time 25 is typically 0.1 to 5 microseconds in duration, and in this example is 1.0 microsecond. The delay time 28 between subsequent heater actuation is 42 microseconds.

The electrical waveform of heater 3 actuation for the non-printing case is given schematically as FIG. 2C. Electrical pulse 25 is 1.0 microsecond in duration, and the time delay 32 between activation pulses is 6.0 microseconds. The small droplets 23, as illustrated in FIG. 2D, are the result of the activation of heater 3 with this non-printing waveform.

FIG. 2E is a schematic representation of an electrical waveform of heater activation for mixed image data where a transition is shown from the non-printing state to the printing state, and back to the non-printing state. Schematic representation FIG. 2F is the resultant ink droplet stream formed. It is apparent that heater activation may be controlled independently based on the ink color required and ejected through corresponding orifice 7, the movement of printhead 17 relative to a print media W, and an image to be printed. It is specifically contemplated that the absolute volume of the small droplets 23 and the large droplets 21 may be adjusted based upon specific printing requirements such as ink and media type or image format and size.

Figure 3:
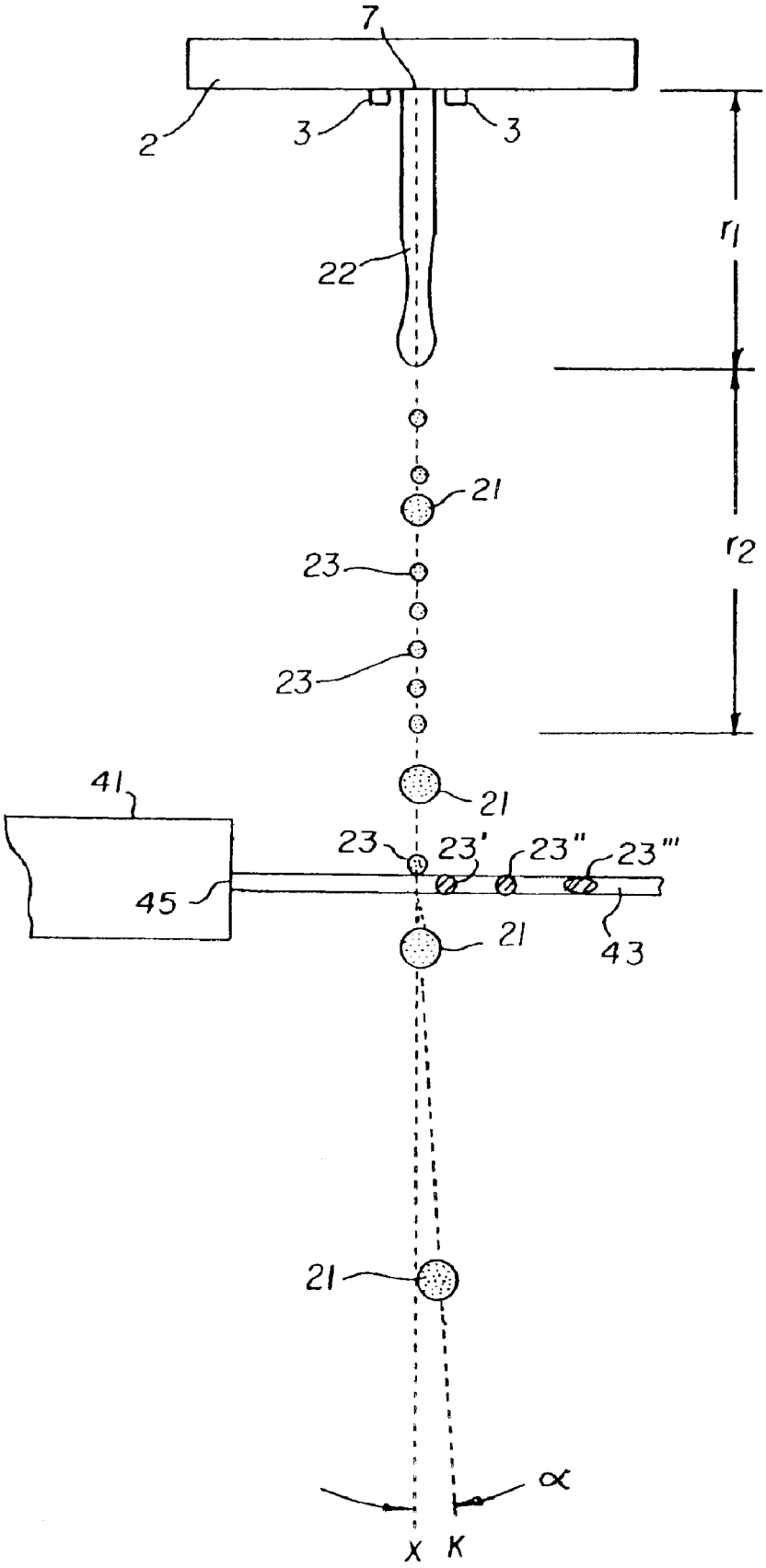
FIG. 3 is a schematic view of the operation of an ink jet printhead made in accordance with the preferred embodiment of the present invention illustrating the droplet filter for generating a liquid curtain between the orifice and a print medium.

With reference now to FIG. 3 which shows an enlarged view of one orifice 7 of FIG. 1, ink is ejected through orifice 7 in printhead 2, creating a filament of working fluid 22 moving substantially perpendicular to printhead 2 along axis X. The physical region over which the filament of working fluid is intact is designated as $r_1$. Heater 3 is selectively actuated at various frequencies according to image data, causing filament of working fluid 22 to break up into a stream of individual ink droplets. As previously described relative to FIGS. 2A–2F, the electrical activation waveforms described above as provided by controller 13 to the heaters 3 result in both small volume droplets 23 and large volume droplets 21. This region of ink break-up and drop coalescence is designated as $r_2$. Following region $r_2$, the drop formation is complete so that droplets are substantially in two size classes: small, non-printing drops 23 and large printing drops 21.

As can also be seen in FIG. 3, the continuous stream printer 1 in accordance with the present invention also includes a droplet filter 41 (only a portion being shown) for producing a liquid curtain 43 which flows perpendicular or orthogonal to the flow direction of the ink droplets axis X. In this regard, the droplet filter 41 preferably includes a source of pressurized ink (not shown), and a nozzle 45 connected to the pressurized ink source for generating the liquid curtain 43 between the orifice 7 and a print medium such as paper. In addition, the nozzle 45 of the droplet filter 41 may be a slit-type opening for ejecting the liquid in the desired curtain configuration. In this regard, the nozzle 45 may be a slit approximately 10 microns in width through which the pressurized ink is jetted therethrough. Of course, this dimension is only one example and different sized nozzles may be used based on the specific application of the present invention. With such a nozzle, the liquid curtain 43 is flat and planar with a broad surface area as compared to the small and large droplets to ensure that the small droplets 23 will be captured thereby in the manner described below.

In accordance with the present invention, the liquid curtain 43 allows ink droplets having a predetermined volume to pass through the liquid curtain 43 but substantially captures ink droplets having a volume smaller than the predetermined volume to thereby prevent them from passing through the liquid curtain 43. In particular, as shown in FIG. 3, the liquid curtain 43 provided by the droplet filter 41 allows the large droplets 21 having at least a predetermined volume to pass through the liquid curtain 43 but captures the small droplets 23 having a volume smaller than the predetermined volume. In this regard, FIG. 3 clearly shows how a small droplet 23 is captured by the liquid curtain 43 and is absorbed therein as shown by droplets 23', 23", and 23''' which shows the dissipation of the small droplet 23 in the liquid curtain. This filtration of the ink droplets is made possible by the fact that large droplets 21 have significantly greater mass and more momentum than the small droplets 23. Consequently, whereas the large droplets 21 penetrate through the liquid curtain 43, the small droplets 23 are prevented from doing so and are absorbed and carried away via the liquid curtain 43.

The size of the ink droplets which are allowed to pass through the liquid curtain 43 depends on a variety of factors including size and speed of the droplets as well as the composition, thickness and flow speed of the liquid curtain 43. It should be noted that whereas various different liquids may be used to generate the liquid curtain, the composition of the liquid curtain 43 is preferably an ink of the same type that forms the small and large ink droplets. This allows the captured small droplets 23 to be recycled and used to generate the liquid curtain 43 and/or the ink droplets thereby simplifying the continuous stream printer 1. In this regard, the continuous stream printer 1 may also include an ink recycler (not shown) for recapturing and recycling ink used to form the liquid curtain 43.

As can also be seen in FIG. 3, the large droplets 21 that pass through the liquid curtain 43 may be slightly deflected by the flow of the liquid curtain 43 which impinges on the large droplets 21. The deflection is most clearly shown by path K which is at a slight angle $\alpha$ from axis X. Thus, the print medium such as paper should be correspondingly positioned to compensate for the slight deflection of the large droplets 21 which are the printing ink drops. Of course, this deflection may be accounted for in any appropriate manner. However, in contrast to the prior art methods and continuous inkjet apparatus, the present invention does not deflect the small and large droplets to separate the printing and non-printing droplets. Instead, the liquid curtain 43 is used in the manner described to filter the small, non-printing droplets from the large, printing droplets.

Referring to FIG. 4, a continuous stream printer 1 (typically, an ink jet printer or printhead) using a preferred implementation of the current invention is shown schematically. Large volume ink droplets 21 and small volume ink droplets 23 as shown in FIG. 3 are formed from ink ejected from the orifice 7 of the printhead 2 in the manner previously described. The continuous stream printer 1 includes a droplet filter 41 for producing a liquid curtain 43 which flows preferably orthogonal to the flow direction of the ink droplets along axis X shown in FIG. 3. As can be seen in the embodiment of FIG. 4, the droplet filter 41 produces a liquid curtain 43 which flows downwardly in the direction of gravity and is positioned between the printhead 2 and the print medium W supported on the print drum 60 so as to allow filtering of print and non-print ink droplets. As also previously described, the droplet filter 41 includes a nozzle 45 which may be a slit-type opening, which in one example may be about 10 microns in width, for ejecting the liquid curtain 43 that allows the large droplets 21 to pass through the liquid curtain 43 along path K to print on the print medium W but captures the small droplets 23.

In operation, the print medium W is transported in a direction transverse to print path K by print drum 60 in any appropriate manner. Transport of the print medium W is coordinated with movement of the printhead 2. This can be accomplished using controller 13 in a known manner. The print medium W may be selected from a wide variety of materials including paper, vinyl, cloth, other fibrous materials, etc. The droplet filter 41 includes a source of pressurized ink which in the present embodiment, includes an ink source 51 for containing a supply of ink 52 to be used in generating the liquid curtain 43. It should be evident that the ink source 51 is significantly larger than conventional ink sources since the ink source 51 in accordance with the present invention must supply the liquid curtain 43 in the manner previously described. In this regard, an ink source having about ten times the capacity of conventional ink sources have been found to be sufficient for generating the liquid curtain 43.

The ink source 51 shown is also provided with an open-cell sponge or foam 54 which prevents ink sloshing in applications where the printhead 2 is rapidly scanned. An ink pump 53 is provided for pressurizing the ink of the ink source 51, and ink passages 55 are provided for conveying the pressurized ink to the droplet filter 41. Of course, the ink pump 53 should have significantly higher capacity than conventional ink pumps since it must create enough pressure and flow rate to generate the liquid curtain 43 as described. An ink recycler 57 is provided opposite the droplet filter 41 for capturing the liquid curtain 43 so that the liquid curtain 43 can be reused.

In the preferred embodiment where the liquid curtain 43 is made of the same ink as the ink used to provide the small and large droplets, the ink from the small droplets 23 captured by the liquid curtain 43 and the ink from the liquid curtain 43 are recaptured by the recycler 57 and recycled into the ink source 51. This recycled ink supply in the ink source 51 is used again to form the liquid curtain 45. In this regard, the present embodiment as shown in FIG. 4 also illustrates another advantage of using the same ink for the liquid curtain 43 as well as the small and large droplets in that the ink supply 52 from the ink source 51 can also be provided to the printhead 2 via ink passage 59 for generation of the small droplets 23 and large droplets 21 which are used for printing. In this regard, the ink source 51 and the ink pump 53 should have increased capacity since the liquid curtain 43 as well as the small and large ink droplets are provided thereby.

Thus, in view of the above, it should be evident that another aspect of the present invention include providing a method of controlling application of ink droplets of a continuous stream inkjet printer on to a print medium. As described above, the method includes the steps of continuously ejecting a stream of ink droplets of a larger or smaller size from an orifice, generating a liquid curtain between the orifice and a print medium, and capturing and absorbing the smaller droplets while admitting the larger droplets to pass through the liquid curtain to the print medium. It should also be evident that the above described method may also include the steps of generating the liquid curtain from a same type of ink that forms the ink droplets and further include the step of recapturing and recycling the liquid curtain.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

PARTS LIST

1 continuous stream printer
2 printhead
3 heater
7 orifice
11 electrical contact pad
13 controller
18 conductor
21 large droplet
23 small droplet
25 electrical pulse time
31 pixel time
32 delay time
41 droplet filter
43 liquid curtain
45 nozzle
51 ink source
52 ink supply
53 ink pump
54 foam
55 ink passage
57 ink recycler
59 ink passage
60 print drum
W print media
X ejection path
K large droplet path
$\alpha$ angle of deflection

What is claimed is:

1. A continuous stream inkjet printer, comprising:

a printhead having an orifice for continuously ejecting a stream of ink droplets of a selected one of a larger and smaller size, and a liquid curtain located between said orifice and a print medium, said liquid curtain comprising a liquid that captures and absorbs said smaller droplets but admits said larger droplets to said print medium.

2. The continuous stream inkjet printer of claim 1, wherein said liquid curtain is substantially orthogonally disposed with respect to said stream of ink droplets.

3. The continuous stream inkjet printer of claim 1, said liquid curtain being generated by a droplet filter, wherein said droplet filter generates said liquid curtain from a same type of ink that forms said ink droplets.

4. The continuous stream inkjet printer of claim 3, wherein said droplet filter includes a source of pressurized ink, and a nozzle connected to said pressurized ink source for generating a curtain of liquid ink between said orifice and a print medium.

5. The continuous stream inkjet printer of claim 4, wherein said droplet filter nozzle has a slit-type opening for ejecting liquid ink in a curtain configuration.

6. The continuous stream inkjet printer of claim 3, wherein said droplet filter includes an ink recycler for recapturing and recycling ink used to form said liquid curtain.

7. The continuous stream inkjet printer of claim 4, wherein said nozzle is directed downwardly such that said liquid curtain is generated in a same direction as the force of gravity.

8. A method of controlling application of ink droplets of a continuous stream inkjet printer onto a print medium, comprising the steps of:

continuously ejecting a stream of ink droplets of a selected one of a larger and smaller size from an orifice;

generating a liquid curtain between said orifice and a print medium, said liquid curtain comprising a liquid; and capturing and absorbing said smaller droplets while admitting said larger droplets to pass through said liquid of said liquid curtain to said print medium.

9. The method of claim 8, wherein said liquid curtain is substantially orthogonally disposed with respect to said stream of ink droplets.

10. The method of claim 8, further including the step of generating said liquid curtain from a same type of ink that forms said ink droplets.

11. The method of claim 10, wherein said liquid curtain is generated between said orifice and a print medium by a source of pressurized ink and a nozzle connected to said pressurized ink source.

12. The method of claim 11, wherein said nozzle has a slit-type opening for ejecting liquid ink in a curtain configuration.

13. The method of claim 11, further including the step of directing said nozzle downwardly such that said liquid curtain is generated in a same direction as the force of gravity.

14. The method of claim 10, further including the step of recapturing and recycling said liquid curtain.

15. A continuous stream inkjet printer, comprising:

a printhead having an orifice for continuously ejecting a stream of ink droplets of a selected one of a larger and smaller size, and a liquid curtain located between said orifice and a print medium that captures and absorbs said smaller droplets but admits said larger droplets to said print medium, said liquid curtain being generated by a droplet filter, wherein said droplet filter generates said liquid curtain from a same type of ink that forms said ink droplets.

16. The continuous stream inkjet printer of claim 15, wherein said droplet filter includes a source of pressurized ink, and a nozzle connected to said pressurized ink source for generating a curtain of liquid ink between said orifice and a print medium.

17. The continuous stream inkjet printer of claim 16, wherein said droplet filter nozzle has a slit-type opening for ejecting liquid ink in a curtain configuration.

18. The continuous stream inkjet printer of claim 16, wherein said nozzle is directed downwardly such that said liquid curtain is generated in a same direction as the force of gravity.

19. The continuous stream inkjet printer of claim 15, wherein said droplet filter includes an ink recycler for recapturing and recycling ink used to form said liquid curtain.

* * * * *